US005351783A

United States Patent [19]

Celli

[11] Patent Number: 5,351,783

[45] Date of Patent: Oct. 4, 1994

[54] SELF-PROPELLED VEHICLE FOR CLIMBING ALONG POLE-SHAPED ELEMENTS, SUCH AS TREE TRUNKS, POLES AND THE LIKE

[75] Inventor: Alfredo Celli, Forli', Italy

[73] Assignee: Alcegarden S.r.l., Forli', Italy

[21] Appl. No.: 974,008

[22] Filed: Nov. 10, 1992

[30] Foreign Application Priority Data

Nov. 15, 1991 [IT] Italy ..... FO91 A 000019
Aug. 12, 1992 [IT] Italy ..... FO92 A 000018

[51] Int. Cl.[5] ..... A63B 27/00
[52] U.S. Cl. ..... 182/133; 182/141
[58] Field of Search ..... 182/187, 188, 133, 141, 182/148

[56] References Cited

U.S. PATENT DOCUMENTS

| | | | |
|---|---|---|---|
| 2,654,638 | 10/1953 | Elliott . | |
| 3,504,767 | 4/1970 | Sherman | 182/187 X |
| 3,520,383 | 7/1970 | Loock | 182/133 |
| 3,727,723 | 4/1973 | Pitcairn . | |
| 3,877,543 | 4/1975 | Iwata | 182/133 |

FOREIGN PATENT DOCUMENTS

| | | |
|---|---|---|
| 0006076 | 12/1979 | European Pat. Off. . |
| 537424 | 10/1931 | Fed. Rep. of Germany . |
| 1148171 | 11/1957 | Fed. Rep. of Germany . |
| 1295780 | 4/1967 | Fed. Rep. of Germany . |
| 3634061 | 4/1988 | Fed. Rep. of Germany . |
| 2190718 | 2/1974 | France . |
| 2294566 | 7/1976 | France . |
| 2658180 | 8/1991 | France . |
| 378584 | 5/1960 | Switzerland . |

*Primary Examiner*—Alvin C. Chin-Shue
*Attorney, Agent, or Firm*—Guido Modiano; Albert Josif; Daniel O'Byrne

[57] ABSTRACT

A climbing vehicle comprising a rigid frame which is provided with a loading platform and is carried by a pair of drive wheels which, in working position, rest against the pole-like element to be climbed. The frame supports a motor element actuating the drive wheels. A pair of arms is articulated at the front of the frame and supports a pair of counteracting wheels which are freely rotatable about a horizontal axis, whereat the counteracting wheels are arranged to be clamped, during work, against the pole-like element to be climbed, in a position opposite to the drive wheels.

14 Claims, 10 Drawing Sheets

SELF-PROPELLED VEHICLE FOR CLIMBING ALONG POLE-SHAPED ELEMENTS, SUCH AS TREE TRUNKS, POLES AND THE LIKE

BACKGROUND OF THE INVENTION

The present invention relates to a self-propelled vehicle for climbing along pole-shaped elements, such as tree trunks, poles and the like.

The use of aerial platforms and of other vehicle-mounted lifting equipment for the vertical movement of persons and goods is known. Such equipment is generally complicated and bulky, as well as expensive, and therefore is not available for all uses.

Often, in order to climb along poles of power and telephone lines or the like it is necessary to resort to conventional ladders, possibly with the aid of appropriate safety belts, with the risks and problems which can be easily understood. One must in fact consider that the operator, in addition to having to carry the necessary tools and materials with him, must have his hands free, once he has reached the operating area, in order to perform the required task.

SUMMARY OF THE INVENTION

The aim of the present invention is to solve the above problem by providing a self-propelled vehicle by means of which the operator can rapidly and effortlessly move along a pole-like element.

Within the scope of this aim, an object of the present invention is to provide a climbing vehicle which is simple in concept, safely reliable in operation and versatile in use.

This aim and this object are both achieved, according to the invention, by the present climbing vehicle for moving vertically along pole-like elements, comprising a rigid frame which is provided with a loading platform and is carried by a pair of drive wheels which, in working position, arranged to rest against a pole-like element to be climbed, a motor element which is supported by said frame and is arranged to actuate said drive wheels, and at least one counteracting wheel which is supported freely rotatable about a horizontal axis by an arm which is articulated to said frame, said counteracting wheel being able to be secured, during work, against the pole-like element to be climbed, in a position opposite to said drive wheels.

BRIEF DESCRIPTION OF THE DRAWINGS

The details of the invention will become evident from the detailed description of a preferred embodiment of the climbing vehicle, illustrated only by way of non-limitative example in the accompanying drawings, wherein.

DESCRIPTION OF THE PREFERRED EMBODIMENTS

Figure 1:
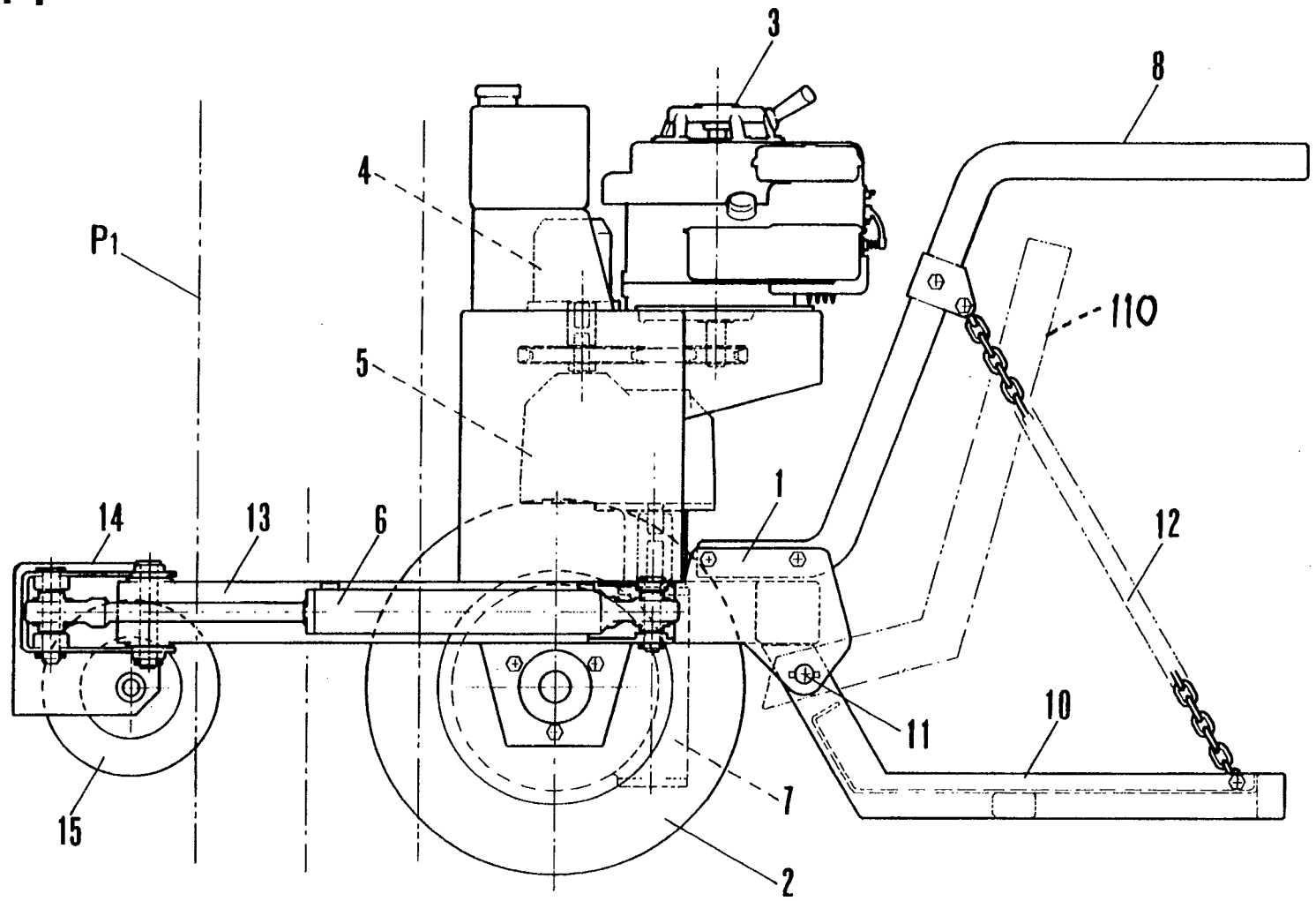
FIG. 1 is a side view of the vehicle according to the invention.
Figure 2:
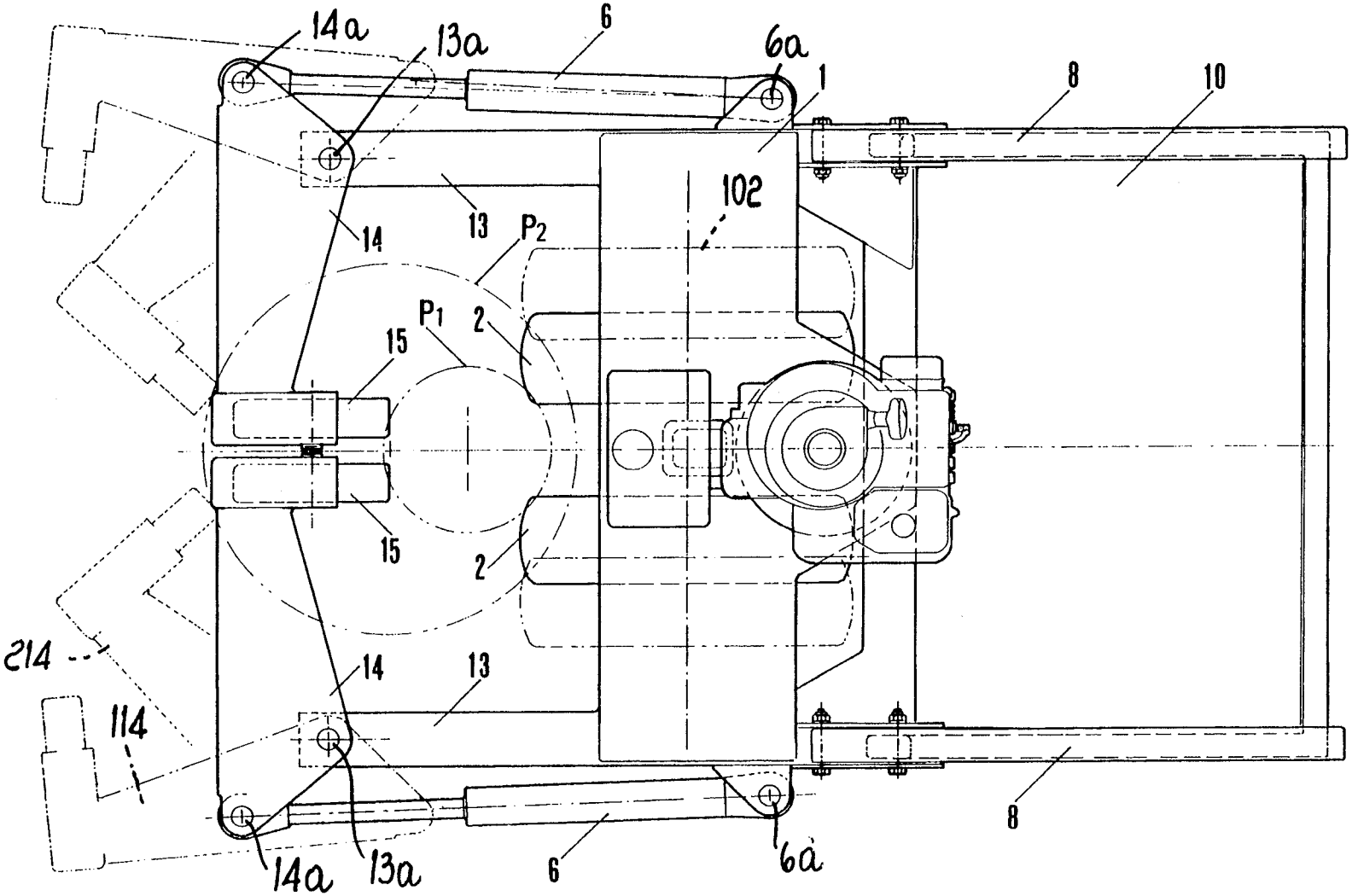
FIGS. 2 and 3 are respectively a top view and a front view of said vehicle.
Figure 3:
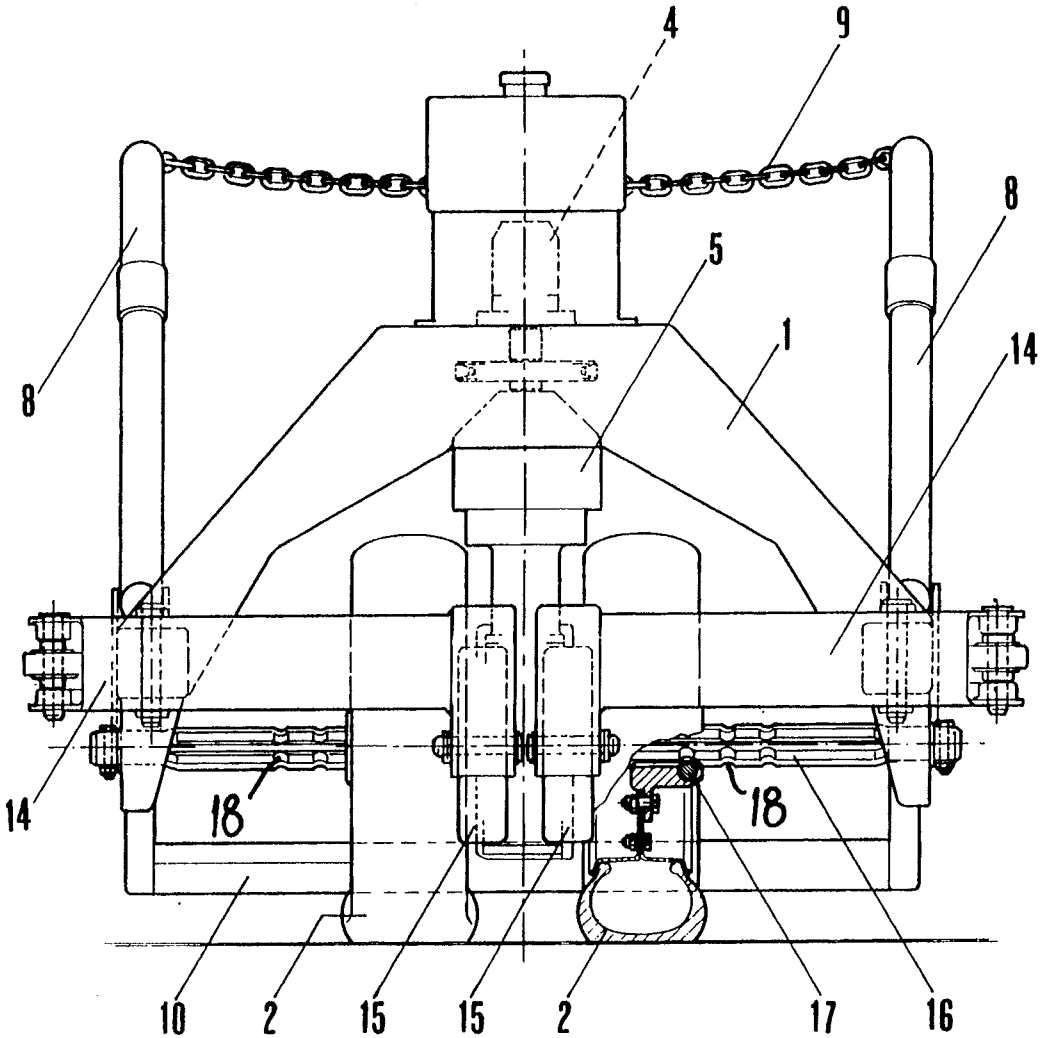

With particular reference initially to FIGS. 1, 2 and 3, the reference numeral 1 designates the rigid frame of the vehicle according to the invention; said frame is supported by a pair of drive wheels 2. The frame 1 supports an internal-combustion engine 3, provided with a fuel tank, and a pair of hydraulic pumps 4 and 5. The first hydraulic pump 4 is arranged to actuate a pair of jacks 6 which are articulated, about vertical pivots 6*a*, to the sides of the frame 1, as specified hereinafter, whereas the second hydraulic pump 5 is arranged for the actuation of a hydraulic motor which is connected to the drive wheels 2 by means of a worm gear reduction unit 7.

Figure 10:
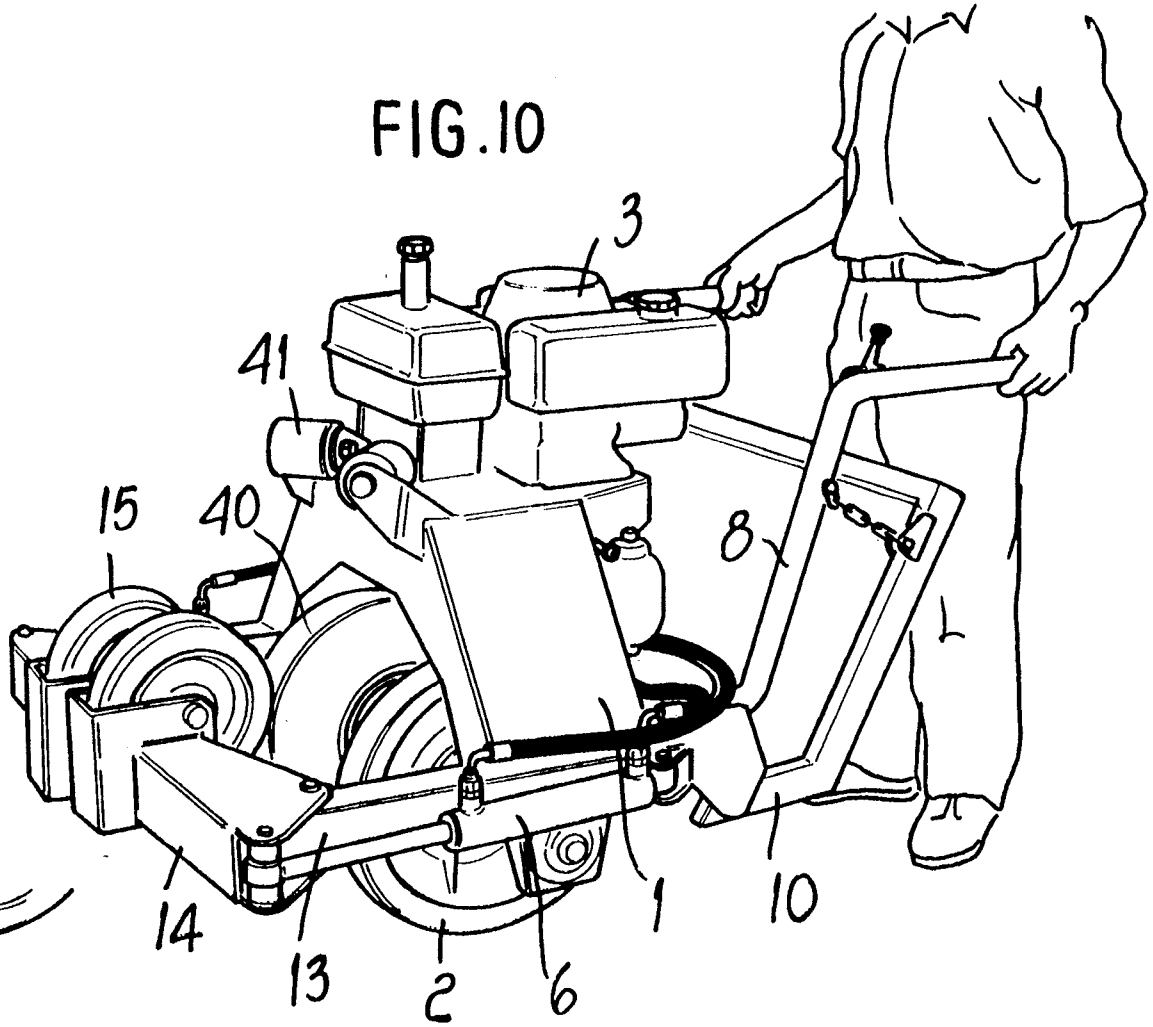
FIG. 10 is a perspective view of said vehicle in the configuration for movement on the ground.
Figure 11:
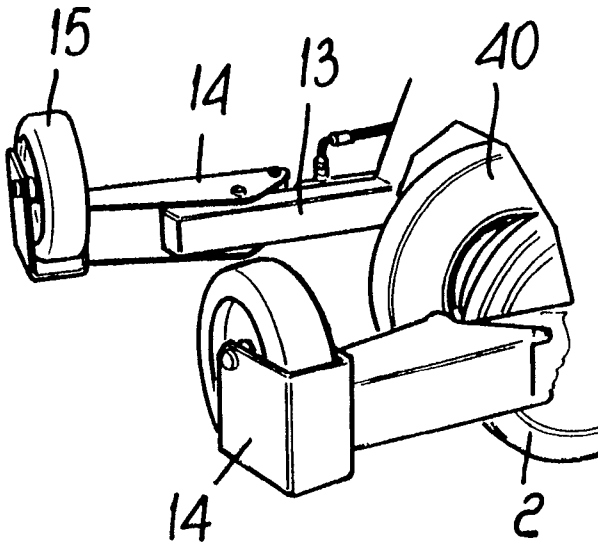
FIG. 11 is a perspective view of the front portion of the vehicle in the configuration for moving toward the pole-like element to be climbed.

A pair of handlebars 8, provided with couplings for a safety belt or chain 9, extend rearward from the frame 1. Below the handlebars 8, the frame 1 is provided with a platform 10 which is articulated thereto and is meant to accommodate the operator during vertical movements. The platform 10 is pivoted on pivots 11 to the frame 1 and is supported in horizontal position by a pair of chains 12 which are fixed to the handlebars 8. The platform 10 can be raised, during movement on the ground, in the position shown by the broken lines 110 in FIG. 1, so as to allow the operator to follow the vehicle by walking between the handlebars 8 (see also FIG. 10).

A pair of horizontal and parallel beams 13 extend at the front from the frame 1; said beams have, at their ends, respective arms 14 which are pivoted thereto about vertical axes 13*a* and are articulated, about the pivots 14*a*, to the jacks 6. At the free end said articulated arms 14 support related counteracting wheels 15 whose diameter is smaller than that of the drive wheels 2, said related counteracting wheels being freely rotatable about a horizontal axis.

Therefore, during the approach of the vehicle to the pole to be climbed, the articulated arms 14 are divaricated as shown by the broken lines 114, so as to arrange themselves on opposite sides of said pole until they rest against it with the drive wheels 2. The extension of the jacks 6 is then actuated so that the articulated arms 14 secure the counteracting wheels 15 against the pole, designated by the outline P1 in FIGS. 1 and 2.

Figure 12:
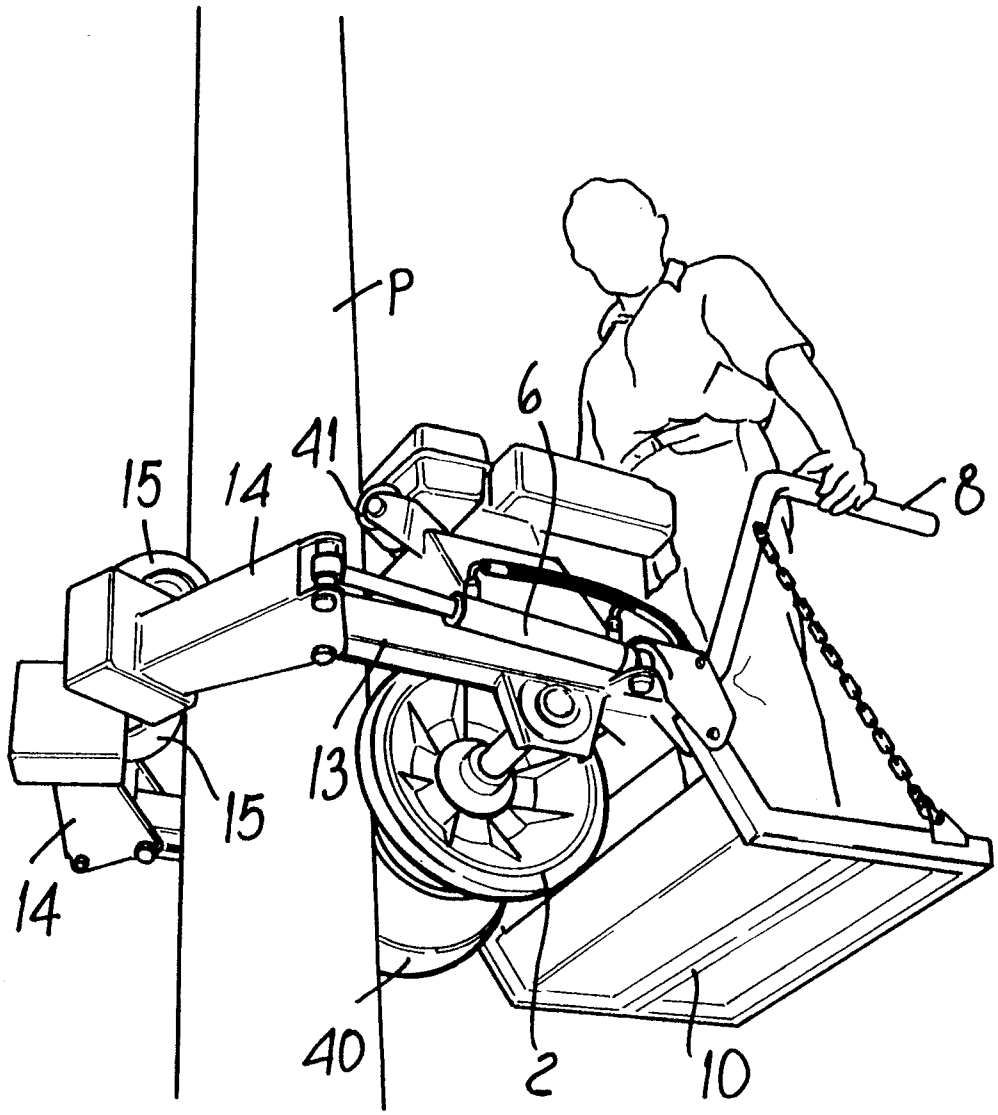
FIG. 12 is a perspective view of the vehicle in the configuration for vertical movement along the pole-like element.

The grip of the wheels 2 and 15 on the resting surface allows the vehicle to move vertically along the pole, under the control of the operator, who is carried on the platform 10 (see also FIG. 12, wherein the pole is designated by P).

Naturally, the closure movement of the articulated arms 14 varies according to the diameter of the pole to be engaged, as shown schematically by the broken lines 214 in FIG. 2, where the outline P2 indicates a pole whose diameter is larger than that of the preceding one.

Conveniently, the drive wheels 2 can be moved symmetrically along the transmission shaft 16, so as to vary the gauge according to the diameter of the pole to be climbed, as shown in broken lines 102 in FIG. 2. The wheels 2 are thus retained on the shaft 16 by means of respective locking elements 17 which are arranged to engage a plurality of seats 18 which are distributed along said shaft.

This gauge variation could alternatively be provided by means of one or more hydraulic jacks which are arranged to actuate the translatory motion of the drive wheels 2 along the shaft 16 and to then keep them in the set position.

The constant and correct clamping of the pole-like element between the drive wheels 2 and the counteracting wheels 15 is conveniently adjusted by a valve which intervenes automatically when the pressure varies, in relation to any changes in the diameter of the pole, keeping the two articulated arms 14 constantly engaged.

If it is convenient to give the vehicle a more stable and safer grip, it is possible to equip each one of the articulated arms 14 with a pair of preferably identical counteracting wheels 15 arranged along horizontal and parallel axes which allow them to follow the same generatrix of the pole-like element.

Furthermore, if the operator and the tools must be carried during movement on the ground as well, the loading platform 10 can be fixed and rigidly coupled to the frame 1, and can be provided with one or more ground resting wheels.

The use of a hydraulic transmission system makes the vehicle compact and allows to have a wide range of speed and power variations. Furthermore, in order to reverse the travel direction it is sufficient to redirect the flow of the oil in the hydraulic motor.

It should furthermore be noted that the use of the worm gear reduction unit 7 offers a high degree of safety, during the vertical movements of the vehicle, by virtue of the non-reversible nature of said reduction unit. However, it is possible to use another type of reduction unit, possibly provided with snap-action or ratchet stops, brakes or other devices able to ensure the necessary safety.

Figure 4:
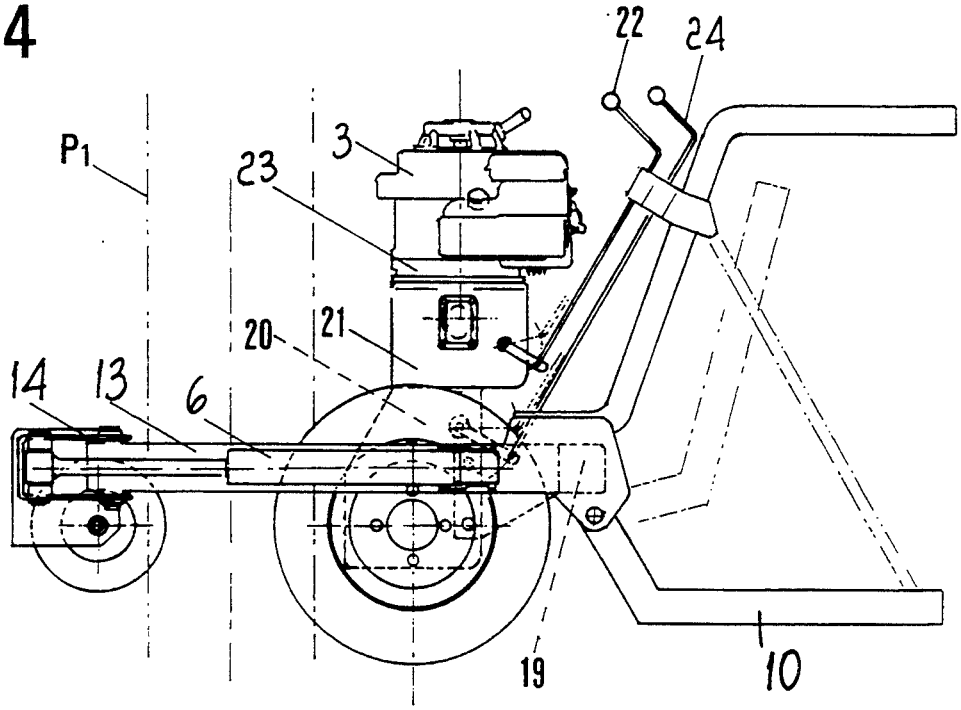
FIGS. 4 and 5 are corresponding side and top views of a different embodiment of the vehicle according to the invention.
Figure 5:
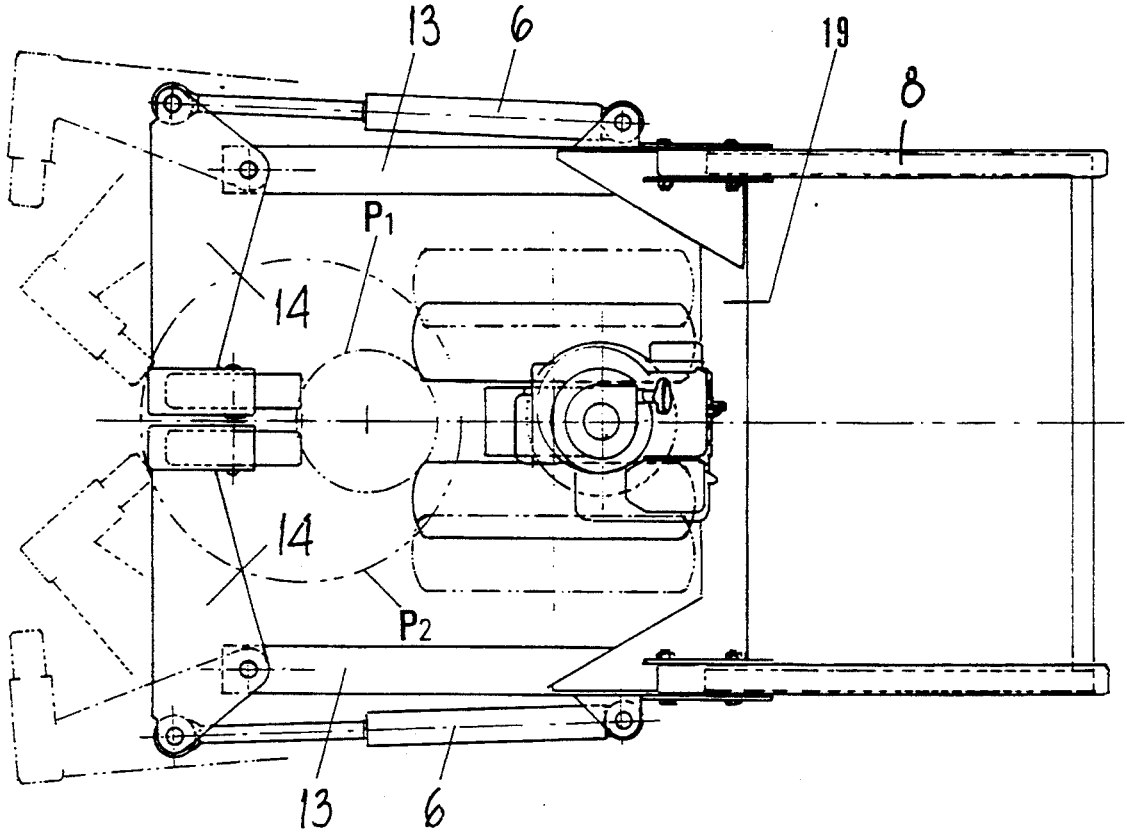

In the embodiment illustrated in FIGS. 4 and 5, the vehicle is provided with a mechanical transmission; this allows, among other things, to limit the frame of the vehicle to a simple structure formed by the pair of beams 13 and by a cross-member 19 which in turn has a gearbox/reduction unit assembly 20 rigidly coupled thereto.

The vehicle is furthermore equipped with a motion inverter 21 actuatable by the lever 22, by a clutch element 23, and by the lever 24 for the actuation of the gearbox.

Figure 6:
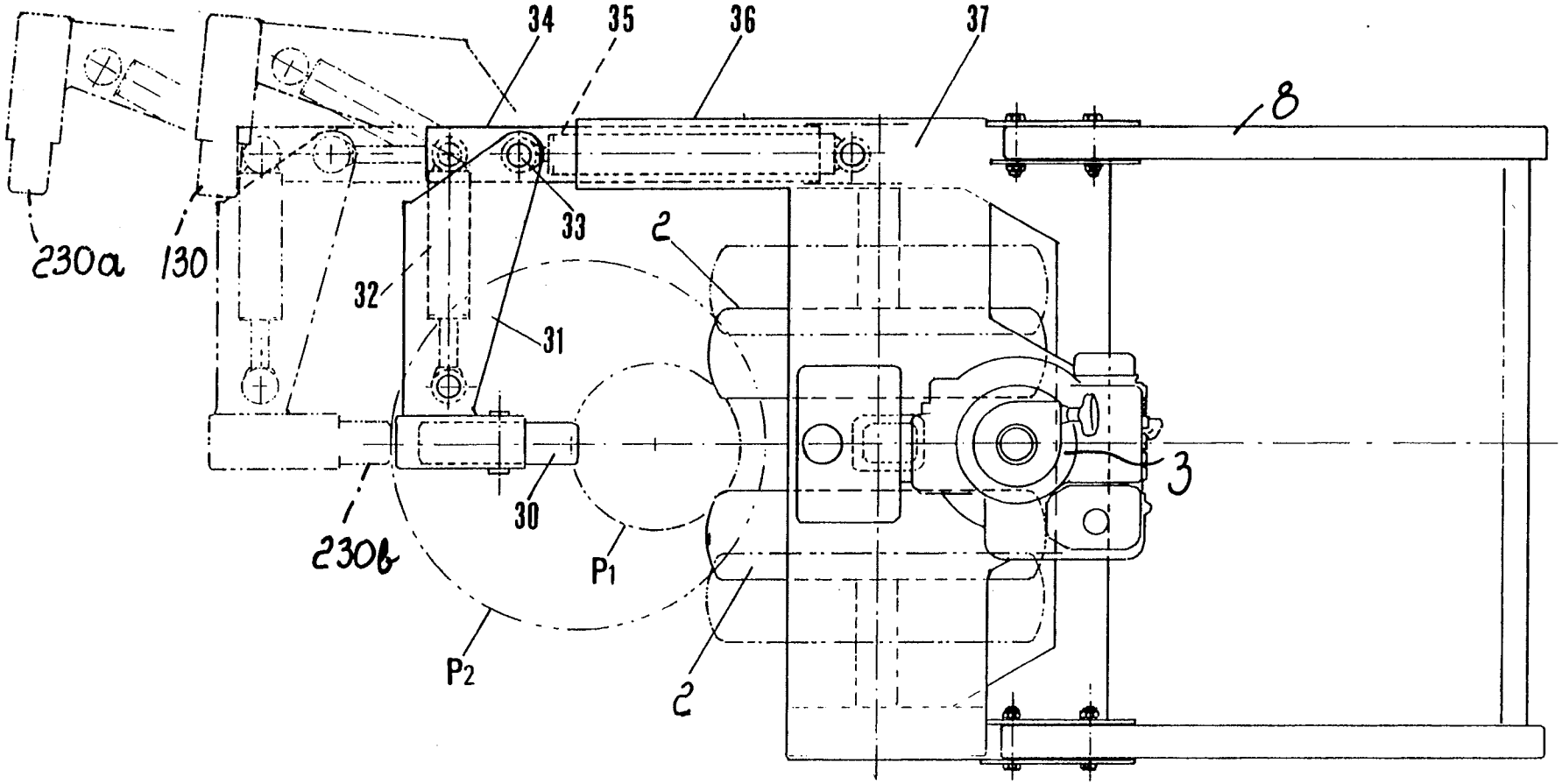
FIG. 6 is a top view of a further embodiment of the vehicle.

The further embodiment illustrated in FIG. 6 has a single counteracting wheel, designated by the reference numeral 30 for the sake of greater clarity. Said counteracting wheel 30 is supported, with a horizontal axis, at the end of an articulated arm 31 which is actuated by a first jack 32 and is vertically pivoted, about a pivot 33, on a rod 34 which can be telescopically extended, by a second jack 35, from the beam 36 which is rigidly coupled to the rigid frame of the vehicle.

The combined movements for the extraction of the rod 34 and for the rotation of the articulated arm 31 allow to move the counteracting wheel 30 to the divaricated position indicated by the broken lines 130, so as to allow the vehicle to approach the pole frontally, until the drive wheels 2 rest thereon, and then clamp said pole by means of said counteracting wheel 30, which is parallel and centered with respect to the wheels 2.

Naturally, in this case, too, the opening and closure movement of the articulated arm 31 will vary according to the diameter of the pole to be clamped, as schematically shown by the broken lines 230*a*, 230*b* related to the pole indicated by P2.

Furthermore, the articulated arm 31 can be equipped, in the manner already described, with a pair of counteracting wheels 30 arranged so as to follow a same generatrix of the pole-like element or otherwise arranged side by side, with a fixed or adjustable gauge.

Figure 7:
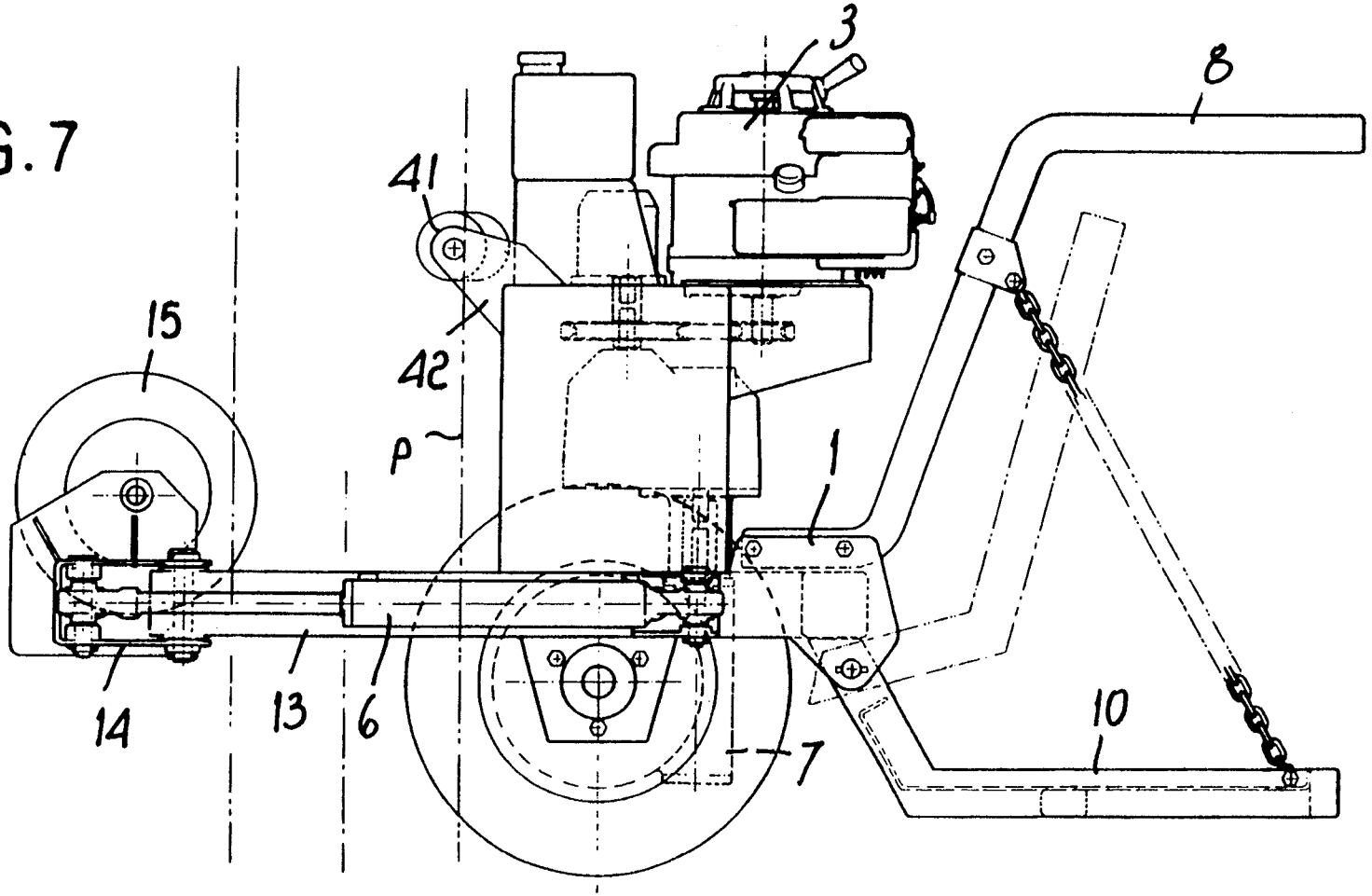
FIGS. 7 and 8 are respectively a side view and a front view of an improved embodiment of the vehicle.
Figure 8:
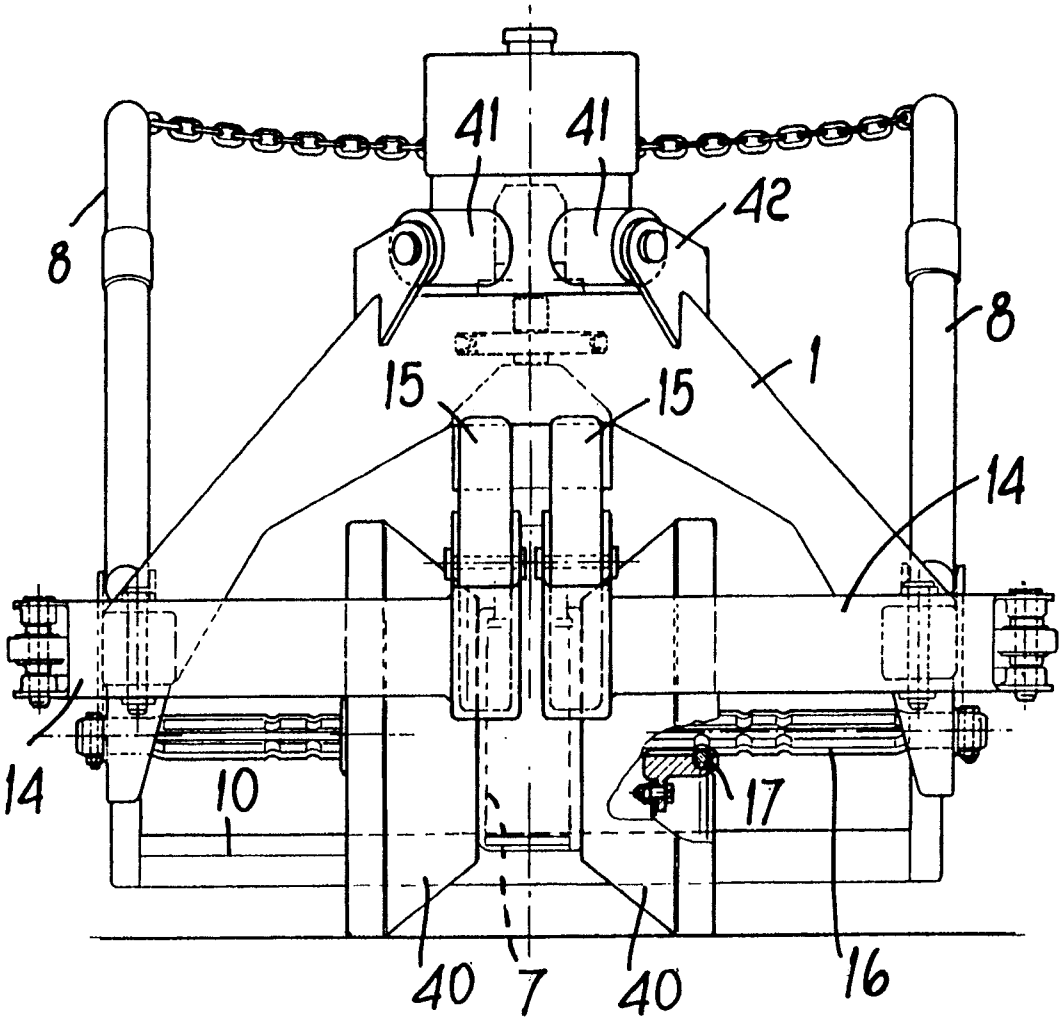

FIGS. 7 and 8 illustrate an improved embodiment of the vehicle, which is structurally similar to the one of FIGS. 1, 2 and 3 described above. Said improved vehicle uses a pair of drive wheels having, toward the inside of the gauge and starting from a substantially cylindrical portion, a frustum-shaped taper 40 which is particularly suitable for vertical movement.

Said drive wheels are preferably provided by means of a light-alloy casting covered by a layer of smooth or grooved rubber. For some specific uses, however, it is possible to provide the frustum-shaped part 40 of the drive wheels with an outer surface made of materials stronger than rubber and grooved so as to ensure the necessary grip.

The converging taper defined as a whole by the two drive wheels defines a sort of guide for the centering of the pole-like element to be climbed, particularly allowing the optimum centering of poles having different diameters P even without varying the gauge, in addition to keeping safely unchanged the attitude and orientation of the vehicle during vertical movements.

The two drive wheels are spaced from the bulk of the reduction unit 7 which is interposed between them, as shown particularly in FIG. 8, wherein said wheels can also be moved along the transmission shaft 16 so as to vary the gauge and are retained by respective locking elements 17 as described above.

Figure 9:
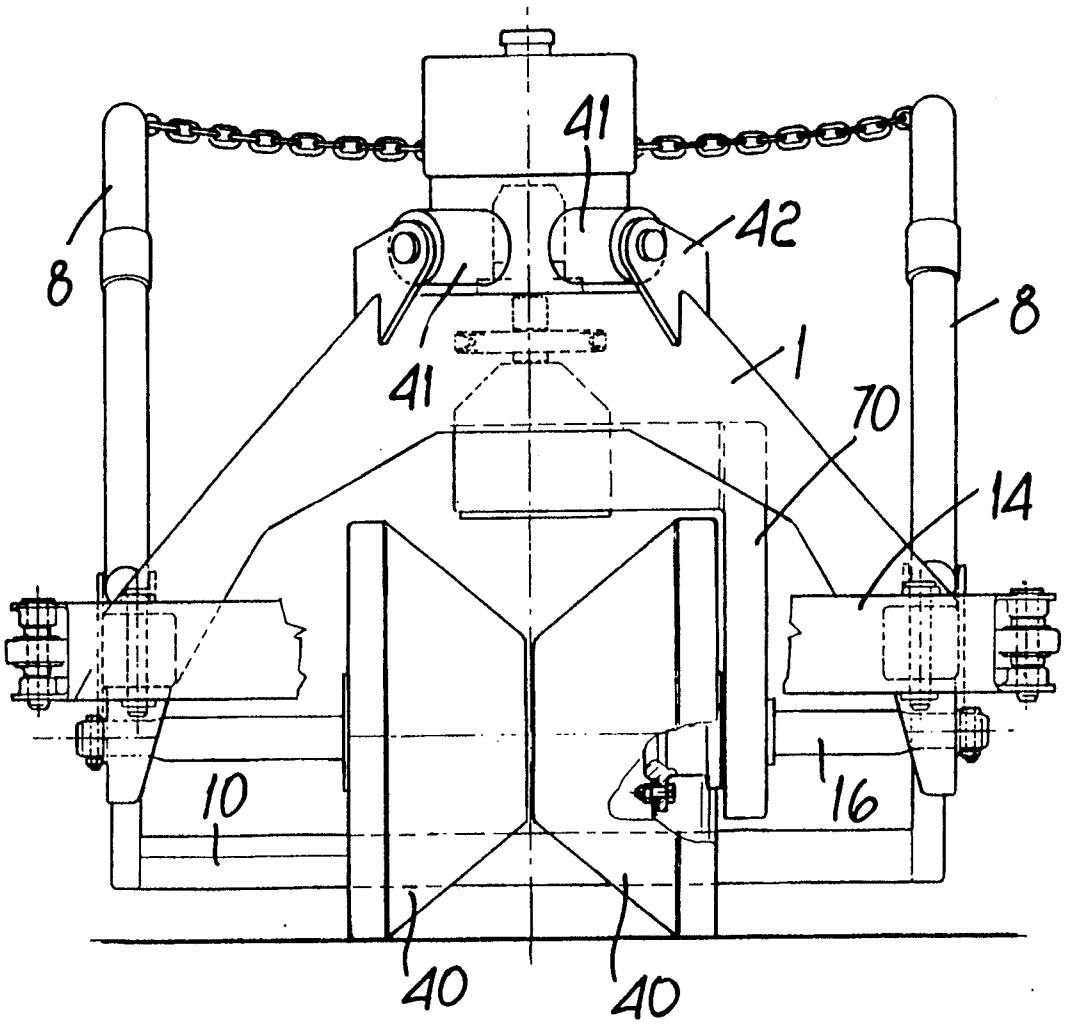
FIG. 9 is a corresponding front view of a different embodiment of said improved vehicle.

In the solution illustrated in FIG. 9, the vehicle is provided with a lateral transmission 70 for the actuation of the drive wheels. This allows to arrange said wheels mutually adjacent, thus allowing to climb even pole-like elements which have a small diameter.

In some cases, in particular for vehicles used on poles having a practically constant diameter, advantageously the drive wheels have a fixed gauge or are defined monolithically.

It is furthermore possible to provide the climber vehicle, both in the fixed-gauge versions and in the variable-gauge versions, with an independent-wheel transmission, so as to allow to correct the attitude and direction of vertical movement.

The improved climbing vehicle furthermore has a pair of stabilizer rollers 41 which are rotatably supported by respective couplings 42 which protrude from the upper part of the rigid frame 1. The rollers 41, preferably made of light alloy and rubber, are arranged along horizontal and converging axes, according to the taper of the underlying drive wheels, so as to rest simultaneously against the pole to be climbed.

Said stabilizer rollers 41 can be mounted on adjustable supports, particularly elastic supports, to allow adaptation of the attitude according to the diameter of the pole, and can have a frustum shape like the drive wheels.

The presence of the stabilizer rollers 41 causes the counteracting wheels 15 to be preferably located at a height which is intermediate between said drive wheels and said rollers. For this purpose, the counteracting wheels 15 are conveniently rotatably supported at the top of related brackets 43 which are rigidly coupled to the articulated arms 14.

Also in the case of the vehicle thus improved, it is possible to make the articulated arms 14 support a pair of counteracting wheels 15 each, said counteracting wheels being arranged along horizontal and parallel axes. Similarly, it is possible to duplicate the stabilizer rollers 41; these last, too, can furthermore be supported on oscillating or elastic supporting means, so as to allow to easy overcome any obstacles present along the pole-like element, especially if one has to climb along tree trunks.

An oscillating track can be mounted on said oscillating supports for the same purpose.

To conclude, the climbing vehicle according to the invention optimally solves the problem of the vertical movement of goods and persons along pole-like elements.

It is easily possible to preset the vehicle for the vertical transport only of materials and goods, said vehicle being guided by means of appropriate remote-control means, like winches and other conventional lifting means.

Especially for embodiments of this type, the loading platform can be wider and balanced, extending on two opposite sides of the vehicle or all around the pole-like element to be climbed; in both cases the platform should conveniently be formed by two or more mutually connected and articulated parts so as to perform the opening and closure movements required for centering on the pole-like element.

In the practical embodiment of the invention, the materials employed, as well as the shapes and dimensions, may be any according to the requirements.

I claim:

1. Climbing vehicle for vertical movement along pole-like elements comprising;

a rigid frame provided with a loading platform;

a pair of drive wheels carrying said frame and, in a working position, resting against a pole-like element to be climbed, said drive wheels each having a drive wheel diameter, a cylindrical portion, and a frustum-shaped taper extending from said cylindrical portion for centering a pole-like element to be climbed;

a motor supported by said frame and actuating said drive wheels;

a pair of horizontal and mutually parallel beams extending frontally from said frame, each of said beams having a free end;

a pair of arms articulated to said beams;

a pair of counteracting wheels each having a diameter smaller than said drive wheel diameter and being freely rotatably supported about a horizontal axis by said arms;

jacks provided said free end of said beams to actuate said arms for clamping said counteracting wheel against a pole-like element to be climbed, in a position opposite to said drive wheels, and;

a pair of handlebars extends rearward from said frame for steering said climbing vehicle, and;

wherein said loading platform is pivoted to said frame about a horizontal axis and raisable during movement of said vehicle on the ground.

2. Climbing vehicle according to claim 1, further comprising;

a pair of couplings protruding from an upper part of said rigid frame and being arranged along horizontal converging axes, and;

a pair of stabilizer rollers freely rotatably supported by said couplings for resting, simultaneously with said drive wheels, against a pole-like element to be climbed in a position opposite to said pair of counteracting wheels.

3. Climbing vehicle according to claim 2, further comprising a pair of brackets coupled to said arms, and;

wherein said counteracting wheels are arranged at an intermediate height with respect to said drive wheels and said stabilizer rollers and are rotatably connected to said brackets.

4. Climbing vehicle according to claim 2, further comprising;

a shaft supporting said drive wheels, said drive wheels defining a gauge therebetween and being symmetrically movable along said shaft for varying said gauge according to a diameter of a pole-like element to be climbed;

a plurality of seats distributed along said shaft;

locking elements coupling said drive wheels to said shaft and engaging said plurality of seats.

5. Climbing vehicle for vertical movement along pole-like elements comprising;

a rigid frame provided with a loading platform;

a pair of drive wheels carrying said frame and, in a working position, resting against a pole-like element to be climbed;

a motor supported by said frame and actuating said drive wheels;

a pair of horizontal and mutually parallel beams extending frontally from said frame, each of said beams having a free end;

at least one arm articulated to said frame;

at least one counteracting wheel; freely rotatably supported about a horizontal axis by said arm;

means for clamping said counteracting wheel against a pole-like element to be climbed, in a position opposite to said drive wheels;

said vehicle further comprising;

a beam connected to said rigid frame;

a telescopically extendable rod connected to said beam for rotation about a vertical axis, said arm being connected to said rod and having an end, said counteracting wheel being connected to said end of said arm for rotation about a horizontal axis;

a first jack for moving said arm with respect to said rod;

a second jack for telescopically extending said rod from said beam.

6. Vehicle for climbing vertical pole-like elements comprising;

a frame;

platform means connected to said frame;

drive wheels supporting said frame for transporting said vehicle in a horizontal direction and for resting against a vertical pole-like element to be climbed;

divaricatable support members pivotally connected to said frame opposite said drive wheels;

counteracting wheels rotatably supported by said divaricatable support members;

means for moving said divaricatable support members and simultaneously moving said counteracting wheels towards and away from said drive wheels, for clamping a pole-like element to be climbed between said drive wheels and said counteracting wheels, and;

means for actuating said drive wheels for ground transportation of said vehicle and upon clamping a pole-like element to be climbed between said drive wheels and said counteracting wheels, wherein said platform means comprise;

an oscillatable platform articulated to said frame by pivots, and;

means for supporting said platform in a horizontal position.

7. Vehicle according to claim 6, further comprising handlebars, and wherein said means for supporting said platform in a horizontal position comprise chains connecting said platform to said handlebars, said platform being oscillatable about said pivots to a raised position for ground transportation of said vehicle.

8. Vehicle according to claim 6, wherein said divaricatable support members comprise;

a pair of beams rigidly connected to said frame;

hydraulic jacks pivotally connected to said frame;

a pair of arms each having a free end, said arms being pivotally connected to said beams about vertical axes and articulated to said hydraulic jacks, said free end of each of said arms rotatably supporting one of said counteracting wheels.

9. Vehicle according to claim 8, wherein said means for moving said divaricatable support members comprise a first hydraulic pump connected to said hydraulic jacks.

10. Vehicle according to claim 9, wherein said means for actuating said drive wheels comprise a second hydraulic pump connected to said drive wheels.

11. Vehicle according to claim 8, wherein said means for moving said divaricatable support members and said means for actuating said drive wheels comprise an internal combustion engine having a first hydraulic pump and a second hydraulic pump, said first hydraulic pump being connected to said hydraulic jacks, said second hydraulic pump being connected to said drive wheels.

12. Vehicle according to claim 8, further comprising;

a pair of couplings protruding from an upper part of said frame and being arranged along horizontal converging axes;

stabilizer rollers freely rotatably supported by said couplings for resting, simultaneously with said drive wheels, against a pole-like element to be climbed in a position opposite to said counteracting wheels, and;

a pair of brackets coupled to said arms;

wherein said counteracting wheels are arranged at an intermediate height with respect to said drive wheels and said stabilizer rollers and are rotatably connected to said brackets.

13. Vehicle for climbing vertical pole-like elements comprising;

a frame;

platform means connected to said frame;

drive wheels supporting said frame for transporting said vehicle in a horizontal direction and for resting against a vertical pole-like element to be climbed;

telescopic support means connected to said frame;

a counteracting wheel rotatably supported by said telescopic support means;

means for moving said telescopic support means and simultaneously moving said counteracting wheels towards and away from said drive wheel, for clamping a pole-like element to be climbed between said drive wheel and said counteracting wheels, and;

means for actuating said drive wheels for ground transportation of said vehicle and upon clamping a pole-like element to be climbed between said drive wheels and said counteracting wheel, wherein said telescopic support means comprise;

a telescopic rod connected to said frame, and;

an arm pivotally connected to said telescopic rod and rotatably supporting said counteracting wheel.

14. Vehicle according to claim 13, wherein said means for moving said telescopic support means comprise;

a first jack pivotally connected to said telescopic rod and to said arm for oscillating said arm with respect to said telescopic rod, and;

a second jack connected to said telescopic rod for actuating telescoping movement thereof.

* * * * *